United States Patent [19]

Nagy

[11] Patent Number: 5,022,881

[45] Date of Patent: Jun. 11, 1991

[54] METHOD FOR MAKING A SPARK PLUG WITH A PREDETERMINED SPARK GAP

[75] Inventor: William L. Nagy, Northwood, Ohio

[73] Assignee: Cooper Industries, Inc., Houston, Tex.

[21] Appl. No.: 756,529

[22] Filed: Jul. 19, 1985

[51] Int. Cl.[5] ..... H01T 21/02

[52] U.S. Cl. ..... 445/7

[58] Field of Search ..... 445/3, 7; 29/407, 445, 29/522 R

[56] References Cited

U.S. PATENT DOCUMENTS

| | | | |
|---|---|---|---|
| 1,304,462 | 5/1919 | Dyer . | |
| 2,003,464 | 6/1935 | Rabezzana | 445/7 |
| 2,139,793 | 12/1938 | Benton | 29/445 |
| 2,356,102 | 8/1944 | Tognola | 123/169 |
| 2,436,675 | 2/1948 | Smith | 445/3 |
| 2,437,205 | 3/1948 | Middleton | 445/7 |
| 2,445,777 | 7/1948 | Hahn | 445/7 |
| 2,542,903 | 2/1951 | Cipriani | 123/169 |
| 2,791,022 | 5/1957 | Stuermer | 29/25.12 |
| 2,791,023 | 5/1957 | Stuermer | 29/25.12 |
| 3,058,211 | 10/1962 | Axtell | 29/522 |
| 3,315,113 | 4/1967 | Lever | 313/136 |
| 4,427,915 | 1/1984 | Nishio | 445/7 |

*Primary Examiner*—Kurt Rowan

*Attorney, Agent, or Firm*—MacMillan, Sobanski & Todd

[57] ABSTRACT

In a method for making a spark plug (10 and 86) with a predetermined spark gap (37), a method for mounting a center electrode assembly (34 and 85) in an insulator bore (25 and 65). A center electrode blank (48 and 80) is positioned in the insulator bore with a tip (36 and 81) projecting to a predetermined location relative to an external shoulder (22 and 62) on the insulator (11 and 55). A thin walled section (49 and 83) of the center electrode blank located above a step (28 and 67) in the insulator bore is heated and deformed to form a shoulder (39 and 84) contacting the bore step.

4 Claims, 3 Drawing Sheets

METHOD FOR MAKING A SPARK PLUG WITH A PREDETERMINED SPARK GAP

TECHNICAL FIELD

This invention relates to spark plug manufacturing and more specifically, in a method for making a spark plug with a predetermined spark gap, to a method for mounting a center electrode assembly in a spark plug insulator bore.

BACKGROUND ART

A common method for manufacturing spark plugs involves assembling a center electrode assembly into an insulator and then mounting the insulator in a tubular shell to which a ground electrode was previously attached. The projecting spark gap tip of the center electrode is trimmed to project to a predetermined location relative to the adjacent end of the spark plug shell and the ground electrode is bent to form a predetermined spark gap. It is necessary to trim the projecting center electrode tip to compensate for tolerance variations in the insulator, the center electrode, the shell and the assembly of these components. There are several disadvantages to trimming the center electrode tip. The exposed tip of the center electrode typically is made from an expensive corrosion resistant metal such as a nickel alloy. Trimming the electrode tip results in a waste of expensive material. If the trimming equipment is not properly adjusted, trimming the tip of the center electrode after it is mounted in the insulator may apply undesirable stresses to the insulator which sometimes can crack the insulator. Trimming also requires equipment and labor which add to the manufacturing costs for the spark plug.

DISCLOSURE OF INVENTION

The invention relates to a novel method for manufacturing spark plugs with a predetermined spark gap. A conventional spark plug insulator having a stepped bore for mounting a center electrode and a radially extending shoulder for seating in a conventional spark plug shell with an attached ground electrode is used. A straight center electrode is positioned in the insulator bore with the electrode tip projecting a predetermined distance from an insulator tip relative to the insulator shoulder. The position of the center electrode in the insulator can be controlled with a jig in which the insulator is positioned. The jig is designed to provide a desired insulator shoulder to center electrode tip spacing. Or, the insulator can be mounted in a spark plug shell having an attached and previously bent ground electrode. The ground electrode is supported by an anvil and a gap gauge having the predetermined spark gap dimension is placed above the ground electrode and the center electrode is positioned to project from the insulator bore and contact the gap gauge.

After the center electrode is positioned in the insulator bore to project to a predetermined location relative to the insulator shoulder, an electric current is passed through the center electrode to heat a thin walled upper end and the upper end is upset to form a head which contacts the insulator bore step. Thus, the center electrode is permanently positioned to project to a predetermined location relative to the insulator shoulder.

If the center electrode is mounted in the insulator prior to mounting the insulator in a spark plug shell, the center electrode assembly is now completed. An electrically consuctive or semi-conductive glass frit may be placed in the insulator bore above the center electrode and heated to a sufficiently high temperature to fuse and form a conductive glass seal in the insulator bore. A terminal may be inserted into the upper end of the insulator bore and embedded in the glass while the glass is soft to complete the center electrode assembly. Or, an electrically conductive or semiconductive powder may be tamped under high pressure in the insulator bore to retain the center electrode and form a conductive seal. The center electrode assembly is completed in a conventional manner, for example, by inserting a spring into the insulator bore and threading and cementing a terminal into the upper end of the insulator bore. The spring is slightly compressed between the seal and the terminal to maintain electrical continuity in the center electrode assembly. After completing the center electrode assembly, the insulator assembly is mounted in a spark plug shell and the ground electrode is bent to form a predetermined spark gap with the center electrode tip in a conventional manner.

If the insulator was mounted in the spark plug shell prior to inserting the center electrode into the insulator bore and forming the head on the center electrode, the center electrode assembly is completed by tamping under high pressure an electrically conductive or semiconductive powder into the insulator bore to retain the center electrode and to form a conductive seal. A spring is inserted into the insulator bore in contact with the tamped powder and a terminal is threaded and cemented in the upper end of the bore to complete the seal. The spring is slightly compressed when the terminal is attached to maintain electrical continuity in the center electrode assembly.

It is an object of the invention to provide an improved method for manufacturing a spark plug with a predetermined spark gap.

The above and other objects and advantages of the invention will become apparent from the following detailed description and the attached drawings.

BEST MODES FOR CARRYING OUT INVENTION

Figure 1:
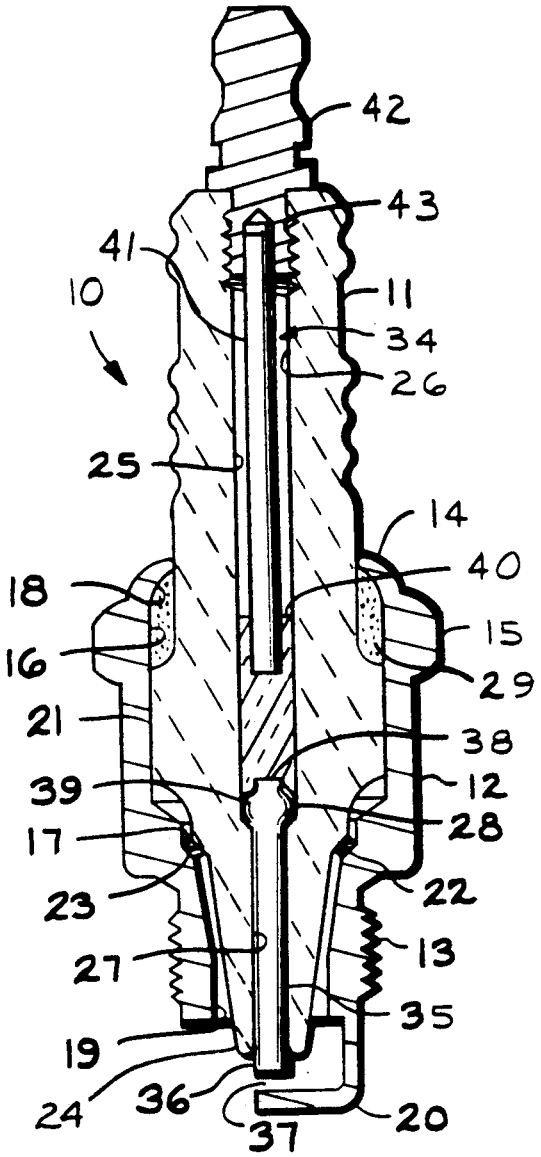
FIG. 1 is a longitudinal cross sectional view of a spark plug manufactured in accordance with the invention.

Referring to FIG. 1 of the drawings, reference numeral 10 denotes a spark plug made according to one mode of the invention. The spark plug 10 includes a ceramic insulator 11 mounted in a tubular metal shell 12. The exterior of the shell 12 has a threaded end 13 for engaging the head of an internal combustion engine (not shown), an opposite end 14 and a hexagonal area 15 intermediate the ends 13 and 14 for receiving a wrench when installing or removing the spark plug 10 in an engine. The shell 12 also has a stepped axial bore 16 which includes a step or shoulder 17 separating a bore section 18 adjacent the shell end 14 and a bore section 19 adjacent the threaded shell end 13. A ground electrode 20 is attached to the shell 12 below the threaded end 13.

The insulator 11 is generally tubular shapped and has a radially extending flange 21 of a size to be received by the shell bore section 18. A shoulder 22 below the flange 21 is adapted to seat either on the shell step 17 or on a gasket 23 positioned between the shell step 17 and the insulator shoulder 22. The insulator 11 has a tip 24 extending below the shoulder 22. The insulator 11 has a stepped central bore 25 including an upper bore section 26 and a lower bore section 27 separated by a step 28.

The insulator 11 is mounted in the shell 12 by any conventional method. In the illustrated spark plug 10, the insulator 11 is positioned in the shell bore 16 with the insulator shoulder 22 seated on the gasket 23 which in turn is seated on the shell step 17. A particulate sealing material 29, such as talc, is tamped under high pressure in the annular space above the flange 21 between the shell 12 and the insulator 11. Sufficient pressure is applied to slightly deform the gasket 23, or the shell step 17 if the spark plug design does not include a gasket 23. The deformed metal forms a seal between the shell and the insulator in addition to the seal formed by the tamped material 29. The shell end 14 is rolled over to retain the tamped material 29 which holds the insulator 11 in the shell 12.

A center electrode assembly 34 is mounted in the insulator bore 25. The center electrode assembly 34 includes a center electrode 35 having at least its surfaces formed of a corrosion resistant metal, such as nickel or a nickel alloy. The center electrode 35 preferably has a core formed of a metal having a high thermal conductivity, such as copper. The center electrode 35 has a tip 36 which forms a predetermined spark gap 37 with the ground electrode 20. Adjacent an opposite end 38 of the electrode 35, an enlarged diameter shoulder 39 is seated on the insulator bore step 28. The shoulder 39 is formed on the center electrode 35 by the method of the invention to provide a predetermined location for the center electrode tip 36 relative to the insulator shoulder 22, without trimming the electrode tip 36 after the center electrode 35 is installed in the insulator bore 25. An electrically conductive or semi-conductive glass seal 40 is fused to the walls of the insulator bore 25 and to the center electrode end 38 to seal the insulator bore 25 and to retain the center electrode 35. A rod 41 is embedded in the seal 40 to electrically connect the seal 40 to a terminal 42 which is threaded and cemented to an upper end 43 of the insulator bore 25.

Figure 2:
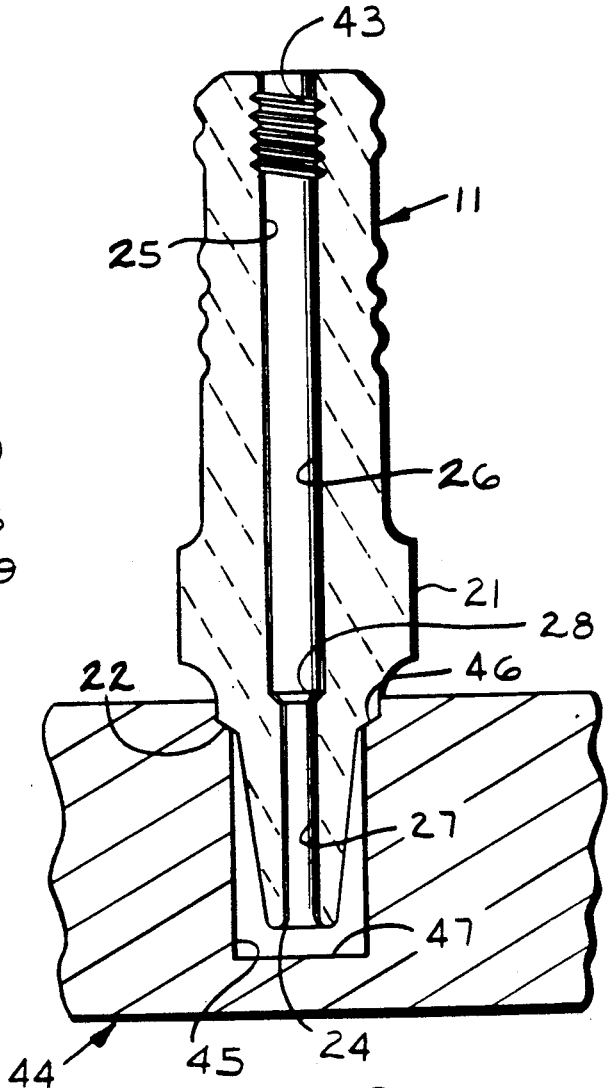
FIG. 2 is a cross sectional view showing a spark plug insulator positioned in a jig.

FIGS. 2-5 illustrate one mode of the invention for locating the center electrode 35 in the insulator bore 25. Prior to assembling the insulator 11 into the shell 12, the insulator 11 is positioned in a jig 44, as illustrated in FIG. 2. The jig 44 has a stepped opening 45 including a step 46 which receives the insulator shoulder 22. The jig opening 45 has a bottom 47 located a predetermined distance below the step 46 for locating the electrode tip 36 relative to the insulator shoulder 22.

Figure 3:
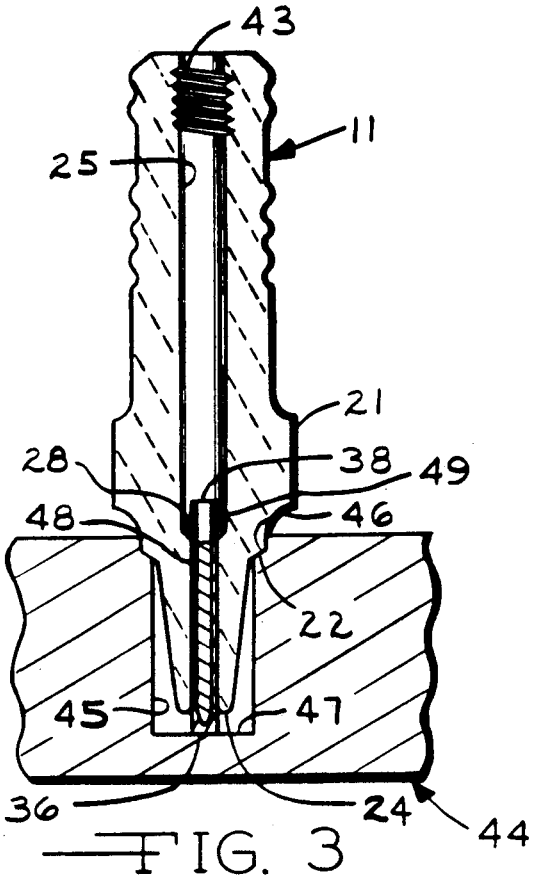
FIG. 3 is a cross sectional view showing the insulator positioned in the jig of FIG. 2 with a center electrode blank positioned in the insulator bore.

After the insulator 11 is positioned in the jig 44 with its shoulder 22 seated on the jig step 46, a center electrode blank 48 is dropped into the insulator bore 25, as illustrated in FIG. 3. The center electrode blank 48 is identical to the center electrode 35, except that the shoulder 39 is not formed. The center electrode blank 48 has the finished tip 36 and has a uniform diameter throughout its length. Therefore, the center electrode blank 48 will fall downwardly through the lower insulator bore section 27 until the tip 36 contacts the jig bottom 47. At the upper end 38, the center electrode blank 48 has a relatively thin walled section 49 extending downwardly at least to the insulator 28 step 25.

Figure 4:
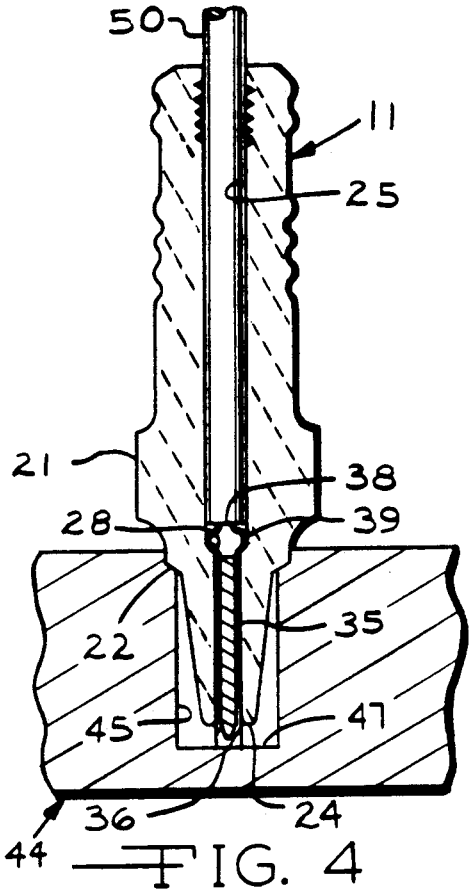
FIG. 4 is a cross sectional view showing the step of upsetting the center electrode to form a shoulder.

A punch 50 is inserted into the insulator bore 25 and moved downwardly until it contacts the upper end 38 of the center electrode 35, as illustrated in FIG. 4. At this time, a voltage is applied between the punch 50 and the jig 44 to pass a high electric current through the center electrode blank 48. The current is controlled to heat the thin walled section 49 and while the section 49 is heated, the punch 50 is advanced to upset the thin walled section 49 into the shoulder 39 which contacts the insulator bore step 28. Accordingly, the shoulder 39 is formed with the center electrode tip 36 precisely located relative to the insulator shoulder 22.

Figure 5:
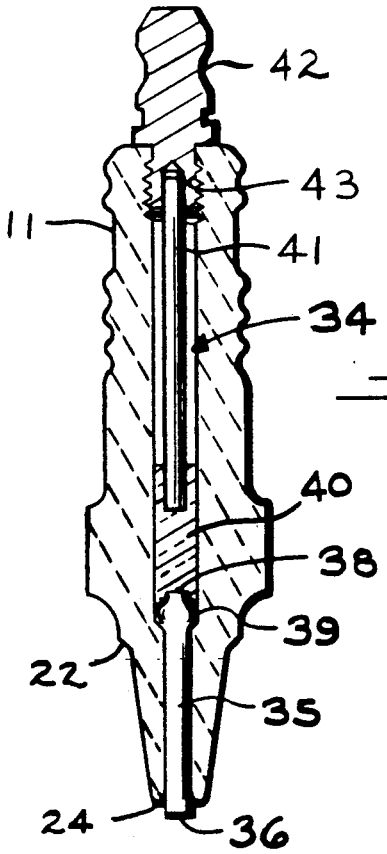
FIG. 5 is a cross sectional view of the completed insulator/center electrode assembly.

After the shoulder 39 is formed to make the center electrode 35, the center electrode assembly 34 is completed in a conventional manner. FIG. 5 illustrates the center electrode assembly 34 having the conductive glass seal 40 with the rod 41 forming a conductor connecting the seal 40 to the terminal 42. Of course, the center electrode assembly above the center electrode 35 may be of other designs known in the art. For example, the glass seal 40 may be of several layers with one or more having semi-conducting properties for ignition noise suppression. Or, a resistor element and a spring may be located in the upper insulator bore section for ignition noise suppression. In another design, the glass seal 40 is replaced with a tamped powder seal. The powder should be electrically conductive or semi-conductive to maintain circuit continuity in the center electrode assembly. After the center electrode assembly 34 is completed, the insulator 11 is mounted in the shell 12 to complete the spark plug 10 shown in FIG. 1.

Figure 6:
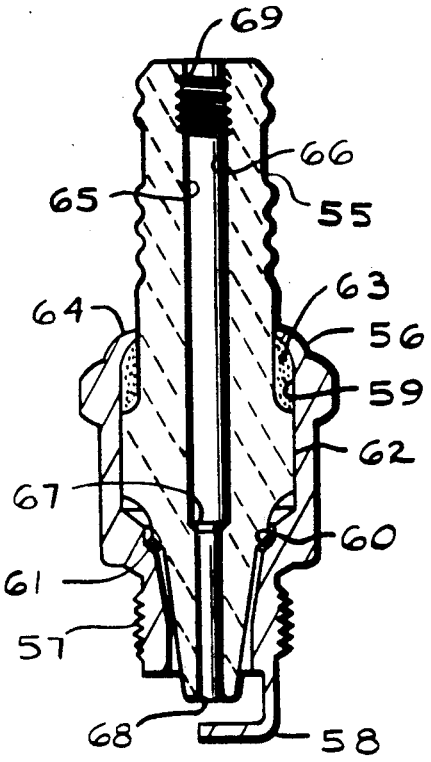
FIG. 6 is a cross sectional view showing an insulator mounted in a shell in accordance with a modified method of the invention.
Figure 7:
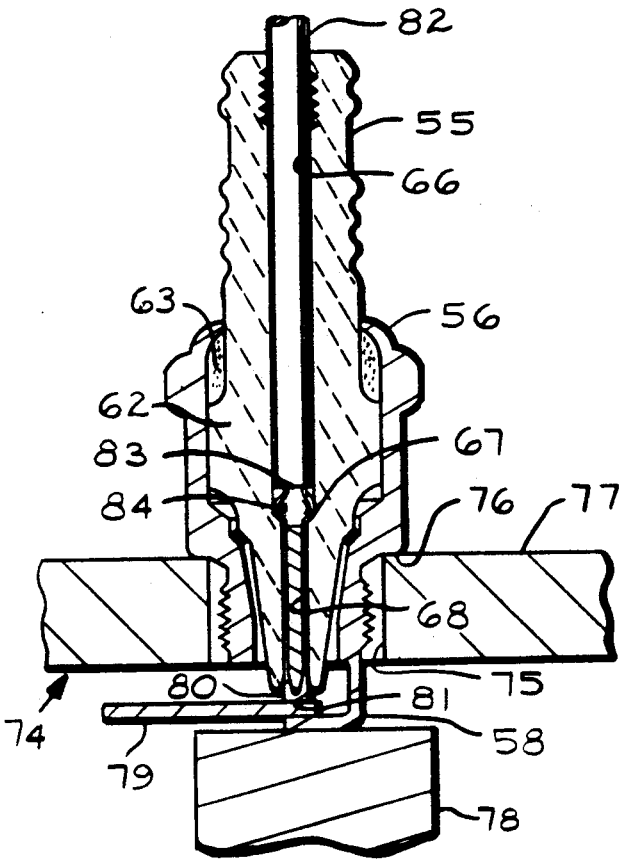
FIG. 7 is a cross sectional view showing the insulator and shell assembly of FIG. 6 illustrating the step of upsetting a shoulder on a center electrode positioned in the insulator bore.
Figure 8:
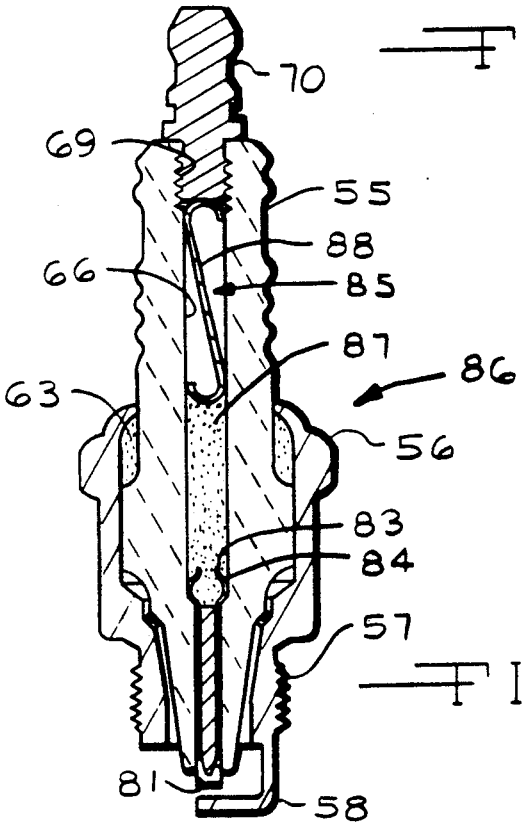
FIG. 8 is a longitudinal cross sectional view of a spark plug made in accordance with the modified method of the invention.

A modified method for making a spark plug with a predetermined spark gap is illustrated in FIGS. 6 through 8. Initially, a ceramic spark plug insulator 55 is mounted in a shell 56. The shell 56 is of a conventional design and includes a threaded end 57 to which a ground electrode 58 is attached and bent to a final configuration. The shell 56 has an axial bore 59 including an upwardly directed step 60. A gasket 61 is positioned on the step 60 and a radially extending flange or shoulder 62 on the insulator 55 is seated on the gasket 61. A conventional particulate sealing material 63, such as talc or a material including talc, is tamped under high pressure in the annular space above the insulator shoulder 62 and between the insulator 55 and the shell 56 and an upper end 64 of the shell 56 is rolled over the tamped material 63 to retain the material 63 and the insulator 55 in the shell 56.

The insulator 55 has an axial bore 65 including an upper bore section 66, an upwardly facing step 67 and a lower bore section 68. The bore 65 is aligned with the previously bent ground electrode 58. The upper end of the upper bore section 66 includes threads 69 for retaining a terminal 70 (FIG. 8).

After the insulator 55 is mounted in the shell 56, the shell 56 is positioned in a shell holder 74 which includes an opening 75 which receives the threaded shell end 57, as illustrated in FIG. 7. A seat 76 on the shell 56 abuts an upper surface 77 on the shell holder 74 and the ground electrode 58 abuts an anvil 78 which is fixed relative to the shell holder surface 77. A gap gauge 79 is positioned above and in contact with the ground electrode 58. The gap gauge 79 has the same thickness as the desired spark gap when the spark plug is finished. A center electrode blank 80 identical to the center electrode blank 48 is dropped into the upper insulator bore section 66 and falls downwardly through the lower bore section 68 until a tip 82 contacts the gap gauge 79. Thus, the gap gauge 79 establishes the spark gap spacing between the center electrode blank 80 and the ground electrode 58 and also locates the center electrode tip 81 relative to the point the insulator shoulder 62 contacts the gasket 61.

A punch 82 is moved downwardly into the upper insulator bore 66 into contact with a thin walled upper end 83 on the center electrode blank 80. A voltage is applied between the anvil 78 and the punch 82 to cause a high electric current to flow through the center electrode blank 80. The electric current heats the thin walls of the center electrode blank at the end 83 and the punch is advanced to upset a shoulder 84 which contacts the insulator bore step 67. The shoulder 84 retains the center electrode blank 80 in the insulator bore 65 and establishes the center electrode tip 81 to ground electrode 58 spark gap spacing at the spacing of the gap gauge 79. It will be appreciated that this spacing is obtained without trimming the center electrode after it is mounted in the insulator. Accordingly, normal dimensional variations in the insulator and the shell are compensated for with minimal stress on the insulator.

After the shoulder 84 is formed on the center electrode blank 80, the punch 82 is withdrawn from the upper bore section 66 and a center electrode assembly 85 is completed to form a finished spark plug 86, as shown in FIG. 8. A suitable electrically conductive or semiconductive particulate sealing material 87 is tamped in the upper insulator bore 66 above the center electrode end 83 to retain the center electrode and to form a seal. The sealing material 87 may be powdered brass, talc to which a conductor such as powdered brass or carbon has been added, or other materials known in the art. A spring, such as an s-shaped scroll spring 88 is positioned in the upper bore section 66 and the terminal 70 is threaded and cemented to the insulator bore threads 69. When the terminal 70 is attached to the insulator 55, the spring 88 is compressed to maintain electrical continuity in the center electrode assembly 85.

It will be appreciated that various modifications and changes may be made to the above described modes of the invention. In the above described embodiments of the invention, the center electrode blank was electrically heated to facilitate the step of upsetting a shoulder on the thin walled end. If desired, the heating step may be omitted. However, additional force may be required to upset the cold thin walled end and additional care may be required to prevent overstressing the insulator. The method of the invention may be used with various known designs for spark plug insulators and shells. Various known methods for mounting the insulator in the shell may be used without departing from the invention. Also, the construction of the center electrode assembly above the shoulder at the upper end of the center electrode is not critical to the invention.

I claim:

1. In a method for making a spark plug with a predetermined spark gap, said spark plug including a tubular shell having an externally threaded end, a ground electrode attached to said shell adjacent said threaded end and an opening through said shell with a step facing away from said threaded end of the shell, an insulator having a shoulder and a central bore having a step, means mounting said insulator in said shell with a seal formed between said insulator shoulder and said shell step, and a center electrode assembly mounted in said insulator bore and including a center electrode seated on said bore step and having a tip projecting from said insulator to form said predetermined spark gap with said ground electrode, a terminal, means for establishing an electrical connection between said center electrode and said terminal and means for forming a seal in said insulator bore, a method for mounting a center electrode assembly in an insulator bore characterized by the steps of:

(a) positioning said insulator in a jig having a seat which receives said insulator shoulder and having a surface at a predetermined location relative to said seat;

(b) inserting a center electrode blank into said insulator bore with a tip projecting from said bore to said predetermined location relative to said insulator shoulder, said center electrode blank tip projecting from said insulator bore and contacting said jig surface when inserted into said insulator bore, said center electrode blank having a thin walled end located in said insulator bore extending above said bore step;

(c) upsetting a shoulder on said thin walled end of said center electrode blank to contact said insulator bore step while maintaining the location of said center electrode blank tip relative to said insulator shoulder by advancing a punch into said insulator bore to deform said thin walled end into said shoulder while maintaining said center electrode blank tip at said predetermined location relative to said insulator shoulder and passing an electric current through said center electrode blank to soften said thin walled end as said punch deforms said thin walled end; and (d) completing said center electrode assembly.

2. In a method for making a spark plug with a predetermined spark gap, said spark plug including a tubular shell having an externally threaded end, a ground electrode attached to said shell adjacent said threaded end and an opening through said shell with a step facing away from said threaded end of the shell, an insulator having a shoulder and a central bore having a step, means mounting said insulator in said shell with a seal formed between said insulator shoulder and said shell step, and a center electrode assembly mounted in said insulator bore and including a center electrode seated on said bore step and having a tip projecting from said insulator to form said predetermined spark gap with said ground electrode, a terminal, means for establishing an electrical connection between said center electrode and said terminal and means for forming a seal in said insulator bore, a method for mounting a center electrode assembly in an insulator bore characterized by the steps of:

(a) mounting said insulator in said shell and bending said ground electrode to a final configuration prior to inserting a center electrode blank into said insulator bore;

(b) positioning said shell in a holder which includes a support for said ground electrode;

(c) positioning a gauge on said ground electrode, said gauge having a thickness equal to said predetermined spark gap;

(d) inserting said center electrode blank into said insulator bore with a tip projecting from said bore to a predetermined location relative to said insulator shoulder, said center electrode blank tip projecting from said insulator bore and contacting said gauge when inserted into said insulator bore, said center electrode blank having a thin walled end located in said insulator bore extending above said bore step;

(e) upsetting a shoulder on said thin walled end of said center electrode blank to contact said insulator bore step while maintaining the location of said center electrode blank tip relative to said insulator shoulder by advancing a punch into said insulator bore to deform said thin walled end into said shoulder while maintaining said center electrode blank tip at said predetermined location relative to said insulator shoulder and passing an electric current through said center electrode blank to soften said thin walled end as said punch deforms said thin walled end; and (f) completing said center electrode assembly.

3. In a method for making a spark plug with a predetermined spark gap, said spark plug including a tubular shell having an externally threaded end, a ground electrode attached to said shell adjacent said threaded end and an opening through said shell with a step facing away from said threaded end of the shell, an insulator having a shoulder and a central bore having a step, means mounting said insulator in said shell with a seal formed between said insulator shoulder and said shell step, and a center electrode assembly mounted in said insulator bore and including a center electrode seated on said bore step and having a tip projecting from said insulator to form said predetermined spark gap with said ground electrode, a terminal, means for establishing an electrical connection between said center electrode and said terminal and means for forming a seal in said insulator bore, a method for mounting a center electrode assembly in an insulator bore characterized by the steps of:

(a) positioning said insulator in a jig having a seat which receives said insulator shoulder and having a surface at a predetermined location relative to said seat;

(b) inserting a center electrode blank into said insulator bore with a tip projecting from said bore to said predetermined location relative to said insulator shoulder, said center electrode blank tip projecting from said insulator bore and contacting said jig surface when inserted into said insulator bore, said center electrode blank having a thin walled end located in said insulator bore extending above said bore step;

(c) upsetting a shoulder on said thin walled end of said center electrode blank to contact said insulator bore step while maintaining the location of said center electrode blank tip relative to said insulator shoulder; and (d) completing said center electrode assembly.

4. In a method for making a spark plug with a predetermined spark gap, said spark plug including a tubular shell having an externally threaded end, a ground electrode attached to said shell adjacent said threaded end and an opening through said shell with a step facing away from said threaded end of the shell, an insulator having a shoulder and a central bore having a step, means mounting said insulator in said shell with a seal formed between said insulator shoulder and said shell step, and a center electrode assembly mounted in said insulator bore and including a center electrode seated on said bore step and having a tip projecting from said insulator to form said predetermined spark gap with said ground electrode, a terminal, means for establishing an electrical connection between said center electrode and said terminal and means for forming a seal in said insulator bore, a method for mounting a center electrode assembly in an insulator bore characterized by the steps of:

(a) mounting said insulator in said shell and bending said ground electrode to a final configuration prior to inserting a center electrode blank into said insulator bore;

(b) positioning said shell in a holder which includes a support for said ground electrode;

(c) positioning a gauge on said ground electrode, said gauge having a thickness equal to said predetermined spark gap;

(d) inserting said center electrode blank into said insulator bore with a tip projecting from said bore to a predetermined location relative to said insulator shoulder, said center electrode blank tip projecting from said insulator bore and contacting said gauge when inserted into said insulator bore, said center electrode blank having a thin walled end located in said insulator bore extending above said bore step;.

(e) upsetting a shoulder on said thin walled end of said center electrode blank to contact said insulator bore step while maintaining the location of said center electrode blank tip relative to said insulator shoulder; and (f) completing said center electrode assembly.

* * * * *